US007878897B2

(12) United States Patent
Toyoda

(10) Patent No.: US 7,878,897 B2
(45) Date of Patent: Feb. 1, 2011

(54) GAMING MACHINE

(75) Inventor: Hirobumi Toyoda, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 804 days.

(21) Appl. No.: 11/902,116

(22) Filed: Sep. 19, 2007

(65) Prior Publication Data

US 2008/0076560 A1 Mar. 27, 2008

(30) Foreign Application Priority Data

Sep. 22, 2006 (JP) ..... 2006-258100

(51) Int. Cl.
*A63F 9/24* (2006.01)

(52) U.S. Cl. ..... 463/20; 463/27; 463/31; 463/46

(58) Field of Classification Search ..... 463/20, 463/27, 31, 46; 119/245
See application file for complete search history.

(56) References Cited

U.S. PATENT DOCUMENTS 5,857,910 A * 1/1999 Watanabe et al. ..... 463/17
2004/0018865 A1 * 1/2004 Gilmore et al. ..... 463/7

FOREIGN PATENT DOCUMENTS

| | | |
|---|---|---|
| JP | A-2001-046583 | 2/2001 |
| JP | A-2005-230190 | 9/2005 |
| JP | A-2006-141634 | 6/2006 |

* cited by examiner

*Primary Examiner*—Peter DungBa Vo
*Assistant Examiner*—Omkar Deodhar
(74) *Attorney, Agent, or Firm*—Arent Fox, LLP

(57) ABSTRACT

A gaming machine includes: a CPU 106 which determines whether or not a game state is to be switched to a special game state; mechanical reels 30A through 30C formed of a translucent material and operative to display multiple kinds of indicating information variably and statically; a motor driving circuit 120 which controls the display operation of the mechanical reels 30A through 30C; a water tank 500 formed of a translucent material to retain liquid, and provided behind a display screen 10; a gaming effects medium insertion device 600 which inserts units of a gaming effects medium 650 into the water tank 500; and a drive control circuit 300 which controls the gaming effects medium insertion device 600 to insert units of the gaming effects medium 650 into the water tank 500 according to a special determination made by the CPU 106.

4 Claims, 12 Drawing Sheets

FIG. 7

GAMING MEDIUM REMOVAL TABLE

| PROBABILITY THAT GAME STATE WILL TRANSIT TO ADVANTAGEOUS GAME STATE (%) | ANGLE BY WHICH GAMING MEDIUM REMOVAL DEVICE IS TO BE TURNED |
|---|---|
| 100 | NOT TURNED |
| 80 | 45 DEGREES |
| 30 | 90 DEGREES |

GAMING MACHINE

This application is based on and claims the benefit of priority from Japanese Patent Application No. 2006-258100, filed on 22 Sep. 2006, the content of which is incorporated herein by reference.

BACKGROUND OF THE INVENTION

1. Field of the Invention

The present invention relates to a gaming machine such as a slot machine, a pachinko-style slot machine, and a pachinko machine.

2. Related Art

With conventional gaming machines (slot machines), upon the player manipulating an operating means (start lever) after the insertion of a predetermined number of units of a gaming medium (coins or the like), a display means (reels or a liquid crystal display device), which displays multiple indicating information on the outer face thereof in the form of multiple lines (e.g., in the form of a 3×3 matrix), beings to scroll.

Furthermore, such gaming machines provide the following game. That is to say, upon the player operating the start lever, reels or the like are rotated a predetermined number of times (for a predetermined period of time), following which the rotation thereof is stopped. Then, such a gaming machine pays out an amount of coins based upon the combination of the indicating information rearranged along an active pay line provided to the display means that allows the player to recognize the indicating information.

In addition, in recent years, various ideas have been proposed for improving visual effects. For example, an idea has been proposed for the aforementioned gaming machines, in which a hollow container filled with a liquid is provided forward of a lower panel of a cabinet of the slot machine. With such an arrangement, movable members such as simulated aquatic plants, simulated fishes, etc., are provided within the hollow container. Furthermore, a bubble generator is provided to the hollow container, which provides bubbles into the liquid thus stored (see Patent Document 1).

With the gaming machine disclosed in Patent Document 1, the bubble generator provides bubbles into the liquid according to the progress and situations of the game, thereby providing improved visual effects.

However, with the gaming machine disclosed in Patent Document 1, such components are mounted at a different location from that of the display means that allows the player to recognize the indicating information of variable display, leading to a problem that such components do not attract much attention from the player. In order to solve this problem, a gaming machine is proposed in which a water tank is provided forward of the display means that allows the player to recognize the indicating information of variable display displayed thereon. Such an arrangement provides improved visual effects, examples of which include bubbles provided within the water tank, visual effects provided by a transparent liquid crystal display device disposed between the water tank and the display means, etc. (see Patent Documents 2 and 3).

With the gaming machines disclosed in Patent Documents 2 and 3, the water tank is provided forward of the display means that allows the player to recognize the indicating information of variable display displayed thereon. Such an arrangement allows the player to recognize the indicating information of variable display displayed on the display means while viewing the visual effects provided by the water tank. Thus, such visual effects attract the player's attention.

[Patent Document 1]

Japanese Unexamined Patent Application, First Publication No. 2001-46583

[Patent Document 2]

Japanese Unexamined Patent Application, First Publication No. 2005-230190

[Patent Document 3]

Japanese Unexamined Patent Application, First Publication No. 2006-141634

However, there is a problem with the gaming machines disclosed in Patent Documents 2 and 3, which have a configuration in which the water tank is provided forward of the display means. That is to say, with such an arrangement, the information provided by the display means is thus displayed to the player through the medium of the water tank. In some cases, if something interrupts the player's view, or if there is a large distance between the display means and the player, the player cannot recognize the information displayed by the display means. Such a problem limits the permissible size and shape of the water tank, leading to such a water tank providing only limited visual effects.

The present invention has been made in view of the aforementioned problem. It is an object of the present invention to provide a gaming machine having improved visual effects by using a water tank, while facilitating the player's ability to visually recognize the information displayed by the display means.

SUMMARY OF THE INVENTION

In order to achieve the aforementioned purpose, the present invention provides the following arrangements.

In a first aspect of the present invention, a gaming machine includes: an operating means for allowing a player to operate the gaming machine; a game control means having a function whereby, when the player performs an operation on the operating means, determination is made of whether or not a game state is to be switched to a special game state advantageous to the player; a display means for displaying multiple kinds of indicating information variably and statically that is formed of a translucent material; a display control means for controlling a display operation of the display means for displaying the indicating information variably and statically, according to the determination made by the game control means; a water tank which is provided behind a display screen for displaying the indicating information provided by the display means, retains liquid, and is formed of a translucent material; a special game control means having a function whereby, when the player operates the operating means, determination is made of whether or not the game state is to be switched to a jackpot game state advantageous to the player; a payout means for paying out units of a gaming medium; a payout control means for performing a control operation which instructs the payout means to pay out an amount of the gaming medium according to the determination made by the game control means; a retention means for deducting a portion from a predetermined amount of the gaming medium to be paid out under the control of the payout control means, and retains the portion thus deducted; an insertion means for inserting units of a gaming effects gaming medium into the water tank; and an insertion control means for controlling the insertion means. With such an arrangement, in a case where the special game control means has made a special determination that the game state is to be switched to a jackpot game state, the payout control means performs a control operation which instructs the payout means to pay out the units of the gaming medium retained by the retention means. Furthermore, the insertion control means performs a control operation which instructs the insertion means to insert units of the gaming effects gaming medium into the water tank according to the special determination made by the special game control means.

According to the first aspect of the invention, when the player performs an operation on the operating means, the game control means determines whether or not the game state is to be switched to a game state advantageous to the player. The display means formed of a translucent material provides a function of displaying multiple kinds of indicating information variably and statically. According to the determination made by the game control means, the display control means controls the display operation of the display means for displaying the indicating information variably and statically. The water tank, which retains liquid and is formed of a translucent material, is provided behind the display screen for displaying the indicating information provided on the display means.

With such an arrangement, the water tank, which retains liquid, is provided behind the display means, which displays the multiple kinds of indicating information variably and statically. Such an arrangement allows the player to simultaneously recognize the multiple kinds of indicating information displayed by the display means via the display screen and the water tank provided behind the display screen. Furthermore, there is no need to take into account a concern of whether or not the water tank interrupts the player's view of the display screen that displays the indicating information provided on the display means (e.g., the reels or liquid crystal display device). Thus, with such an arrangement, the depth dimension of the water tank can be greater as compared with an arrangement in which the water tank is provided forward of the display means. Various kinds of items which provide visual effects (e.g., simulated pirate ships, simulated tropical fish, and simulated aquatic plants, all of which can be moved by magnetic force) can be arranged within such a water tank thus designed.

With such an arrangement, when the player manipulates the operating means, the special game control means makes a special determination of whether or not the game state is to be switched to a jackpot game state advantageous to the player. The payout control means performs a control operation which instructs the payout means to pay out a predetermined amount of the gaming medium according to the determination made by the game control means. The retention means deducts a portion from the predetermined amount of the gaming medium to be paid out under the control of the payout control means, and retains the portion thus deducted.

Furthermore, in a case where the special game control means has made a special determination that the game state is to be switched to the jackpot game state, the payout control means performs a control operation which instructs the payout means to pay out the units of the gaming medium thus retained by the retention means. The insertion control means performs a control operation which instructs the insertion means, which has a function of inserting units of the gaming effects gaming medium into the water tank, to insert units of the gaming effects gaming medium into the water tank according to the special determination made by the special game control means.

With such an arrangement, in a case where a special determination has been made that the game state is to be switched to the jackpot game state (the so-called jackpot), the units of the gaming medium accumulatively retained by the retention means are paid out.

Furthermore, such an arrangement provides a function of inserting units of the gaming effects gaming medium into the water tank, which serves as a notice that the game state will transit to the jackpot game state (jackpot).

With such an arrangement, the indicating information provided by the display means are displayed variably and statically according to the determination made by the game control means of whether or not the game state is to be switched to the special game state advantageous to the player. In addition, such an arrangement provides game effects using the water tank, which displays a notice that the game state will transit to the jackpot game state (jackpot). Thus, with such an arrangement, visual effects, including the display of indicating information variably and statically, and the insertion of the gaming effects gaming medium into the water tank, are displayed in a superimposed manner. The player is thus notified that the game state will transit to the advantageous game state or the jackpot game state (jackpot), which is of great interest to the player. This improves visual effects provided by the water tank.

Thus, such an arrangement provides improved game effects when using the water tank, while facilitating the player's ability to visually recognize the information displayed by the display means.

In a second aspect of the gaming machine as described in the first aspect of the present invention, the gaming machine may further include: a removal means for removing the units of the gaming effects gaming medium, which have been inserted into the water tank by the insertion means, from the interior of the water tank; and a removal control means for controlling the removal means according to the special determination made by the special game control means.

According to the second aspect of the invention, the removal control means performs a control operation which instructs the removal means to remove the units of the gaming effects gaming medium, which have been inserted into the water tank, from the interior of the water tank according to the special determination made by the special game control means.

Such an arrangement provides a function of removing the units of the gaming effects gaming medium, which have been inserted into the water tank by the insertion means, according to the special determination of whether or not the game state is to be switched to the jackpot game state (jackpot).

For example, with such an arrangement, the game control means makes a special determination by random number lottery of whether or not the game state is to be switched to the jackpot game state (jackpot), upon which the removal control means performs a control operation which instructs the removal means to remove a quantity of the gaming effects gaming medium with reference to the removal table according to the special determination of whether or not the game state is to be switched to the jackpot game state advantageous to the player. A storage means is provided for storing the removal table that specifies the relation between the probability that the game state will transit to the jackpot game state, which is used in the random number lottery processing, and the quantity of the gaming effects gaming medium to be removed by the removal means. In the removal table, the quantity of the gaming effects gaming medium to be removed by the removal means is inversely proportional to the probability that the game state will transit to the jackpot game state. With such an arrangement, the quantity of the gaming effects gaming medium removed by the removal means becomes smaller as the probability that the game state will transit to the jackpot game state becomes higher. With such an arrangement, the quantity of the gaming effects gaming medium removed by the removal means further enhances the player's sense of expectation with respect to the game state transition to the jackpot game state.

Thus, such an arrangement provides improved game effects when using the water tank, while facilitating the player's ability to visually recognize the information displayed by the display means.

In a third aspect of the gaming machine as described in the first or second aspect of the present invention, the gaming machine may further include a gaming effects retention means for retaining in the water tank the units of the gaming effects gaming medium inserted into the water tank by the insertion means. With such an arrangement, the insertion control means may perform a control operation which instructs the insertion means to insert into the water tank a quantity of the gaming effects gaming medium according to the amount of the gaming medium retained by the retention means.

According to the third aspect of the invention, the gaming effects retention means retains in the water tank the units of the gaming effects gaming medium inserted into the water tank by the insertion means. The insertion control means instructs the insertion means to insert into the water tank a quantity of the gaming effects gaming medium according to the amount of the gaming medium retained by the retention means.

With such an arrangement, the quantity of the gaming effects gaming medium retained by the gaming effects retention means serves as an indicator that indicates the amount of the gaming medium which is to be paid out via the payout means under the control of the payout control means according to the special determination made by the special game control means that the game state is to be switched to the jackpot game state (jackpot). With such an arrangement, based upon the quantity of the gaming effects gaming medium retained in the water tank by the gaming effects retention means, the player can estimate the amount of the gaming medium that is to be paid out when the game state transits to the jackpot game state, thereby enhancing the player's sense of expectation.

Thus, such an arrangement provides improved game effects when using the water tank, while facilitating the player's ability to visually recognize the information displayed by the display means.

According to the present invention, a water tank, which retains liquid, is provided behind a display screen for displaying indicating information provided by a display means, which has a function of displaying multiple kinds of indicating information variably, and is formed of a translucent material. An insertion control means performs a control operation which inserts units of a gaming effects gaming medium into the water tank according to a special determination made by a special game control means. Thus, such an arrangement provides improved game effects when using the water tank, while facilitating the player's ability to visually recognize the information displayed by the display means.

BRIEF DESCRIPTION OF THE DRAWINGS

FIG. 7 is a diagram showing a gaming medium removal table according to the embodiment of the present invention;

DETAILED DESCRIPTION OF THE INVENTION

A detailed description is provided below regarding embodiments of the present invention.

First Embodiment

Figure 1:
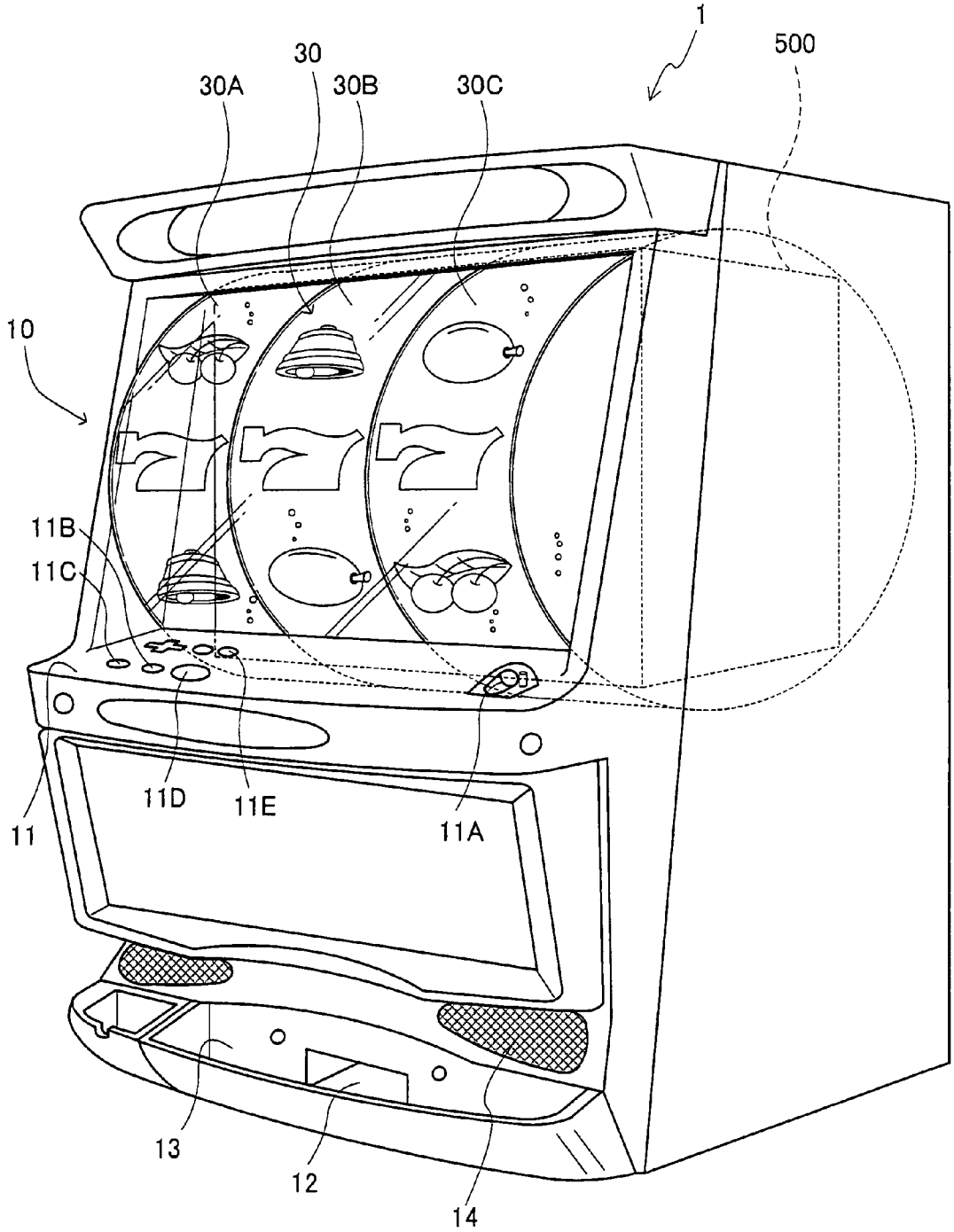
FIG. 1 is a perspective view showing the exterior of a slot machine according to a first embodiment of the present invention.

FIG. 1 is a perspective view showing the exterior of a slot machine 1 according to a first embodiment of the present invention. The slot machine 1 according to the embodiment of the present invention includes a reel group 30, an operation panel 11, a coin payout opening 12, a coin tray 13, and a sound output unit 14. It should be noted that slot machines can be roughly classified into two types. One is a slot machine having a configuration in which mechanical reels are rotated. The other is a so-called video slot machine having a configuration in which multiple virtual reels are rotated in the form of an image displayed on a screen. While a description is provided in the present embodiment regarding a slot machine employing mechanical reels, the present invention may also be applied to a video slot machine.

The slot machine 1 is installed at a predetermined location in an amusement facility such as a casino, etc. Furthermore, the slot machine 1 includes a control device 100 (see FIG. 4) or the like mounted therewithin for electrically controlling each component thereof. A description is provided later regarding the control device 100.

The reel group 30 has a configuration in which three cylindrical mechanical reels 30A through 30C are rotatably provided along a horizontal line. Furthermore, the mechanical reels 30A through 30C are provided such that they can rotate around the circumference of a water tank 500. Multiple kinds of indicating information are provided on the outer face of each of the mechanical reels 30A through 30C. Such an arrangement displays the indicating information variably and statically on a display screen 10 that allows the player to recognize the indicating information. The multiple kinds of indicating information include a "red 7" design, a "blue 7" design, a "BAR" design, a "bell" design, a "watermelon" design, and a "cherry" design. Here, each of the three mechanical reels 30A through 30C is formed of a translucent material.

In other words, the mechanical reels 30A through 30C provide a function of displaying the multiple kinds of indicating information variably and statically. That is to say, the mechanical reels 30A through 30C serve as an example of a display means formed of a translucent material. Furthermore, each of the mechanical reels 30A through 30C is formed in a cylindrical shape, on the outer face of which are depicted multiple kinds of indicating information. Each reel is provided such that it can be rotated around the circumference of the water tank.

The operation panel 11 includes a coin insertion opening 11A which allows the player to insert coins into the slot machine 1. Furthermore, the operation panel 11 includes a BET switch 11B which allows the player to select the number of coins, which serve as the units of the gaming medium used in the game by the player. Moreover, the operation panel 11 includes a spin repeat BET switch 11C which allows the player to play the game again without changing the number of coins to be spent in the game from that in the immediately previous game. The slot machine 1 allows the player to set the number of coins to be spent in the game by performing a pushing operation on either the BET switch 11B or the spin repeat BET switch 11C.

Furthermore, the operation panel 11 includes a start switch 11D, which is a game start instruction receiving means that allows the player to input the game start instruction in increments of games. With the slot machine 1, upon the player performing a pushing operation on either the spin repeat BET switch 11C or the start switch 11D, a start operation signal is transmitted to a CPU 106 (see FIG. 4) described later. This starts the game, upon which a scrolling operation is performed for the reel group 30.

Furthermore, the operation panel 11 includes a payout switch 11E. Upon the player performing a pushing operation on the payout switch 11E, the coins inserted by the player are paid out via the coin payout opening 12. The coins to be paid out are retained in the coin tray 13.

Figure 2:
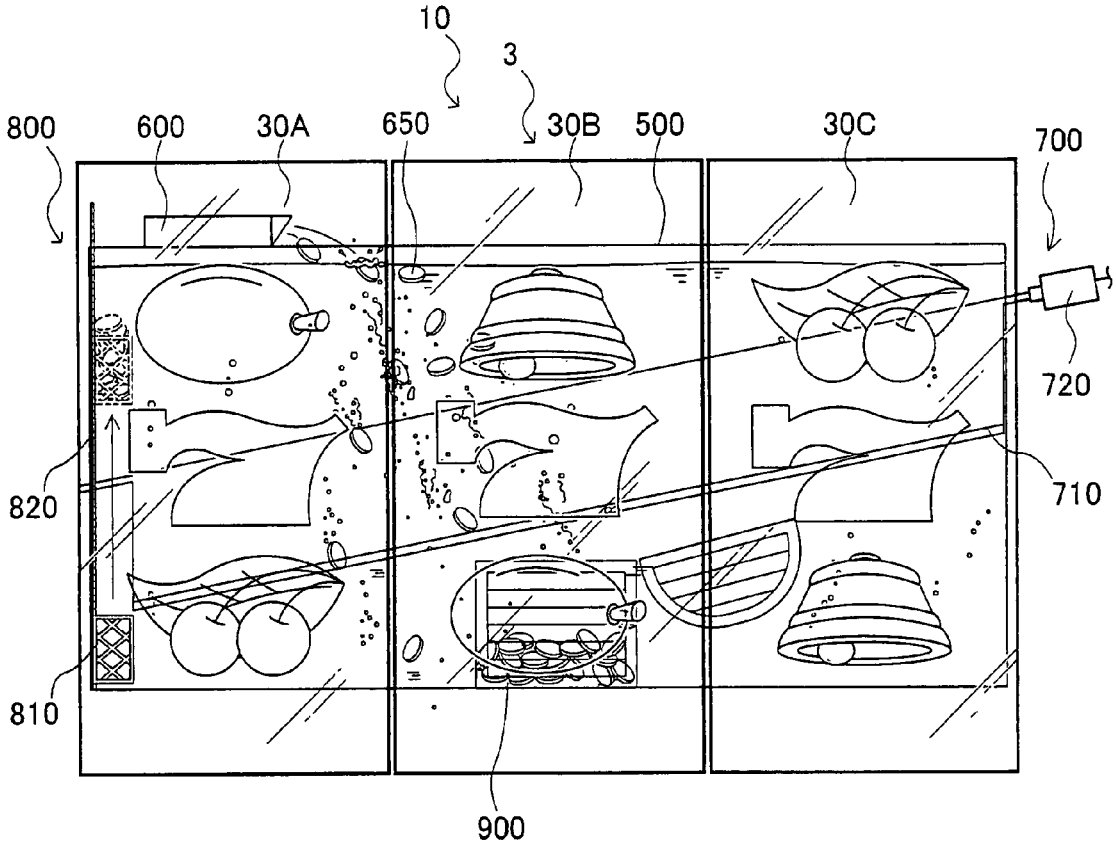
FIG. 2 is a front view showing a reel group, a water tank, a gaming effects gaming medium insertion means, a gaming effects gaming medium removal device, a gaming effects gaming medium collection device, and a retaining unit, included in the slot machine according to the first embodiment of the present invention.

FIG. 2 is a front view showing the reel group 30, the water tank 500, a gaming effects gaming medium insertion device 600, a gaming effects gaming medium removal device 700, a gaming effects gaming medium collection device 800, and a retaining unit 900, included in the slot machine 1 according to the first embodiment of the present invention.

Figure 3:
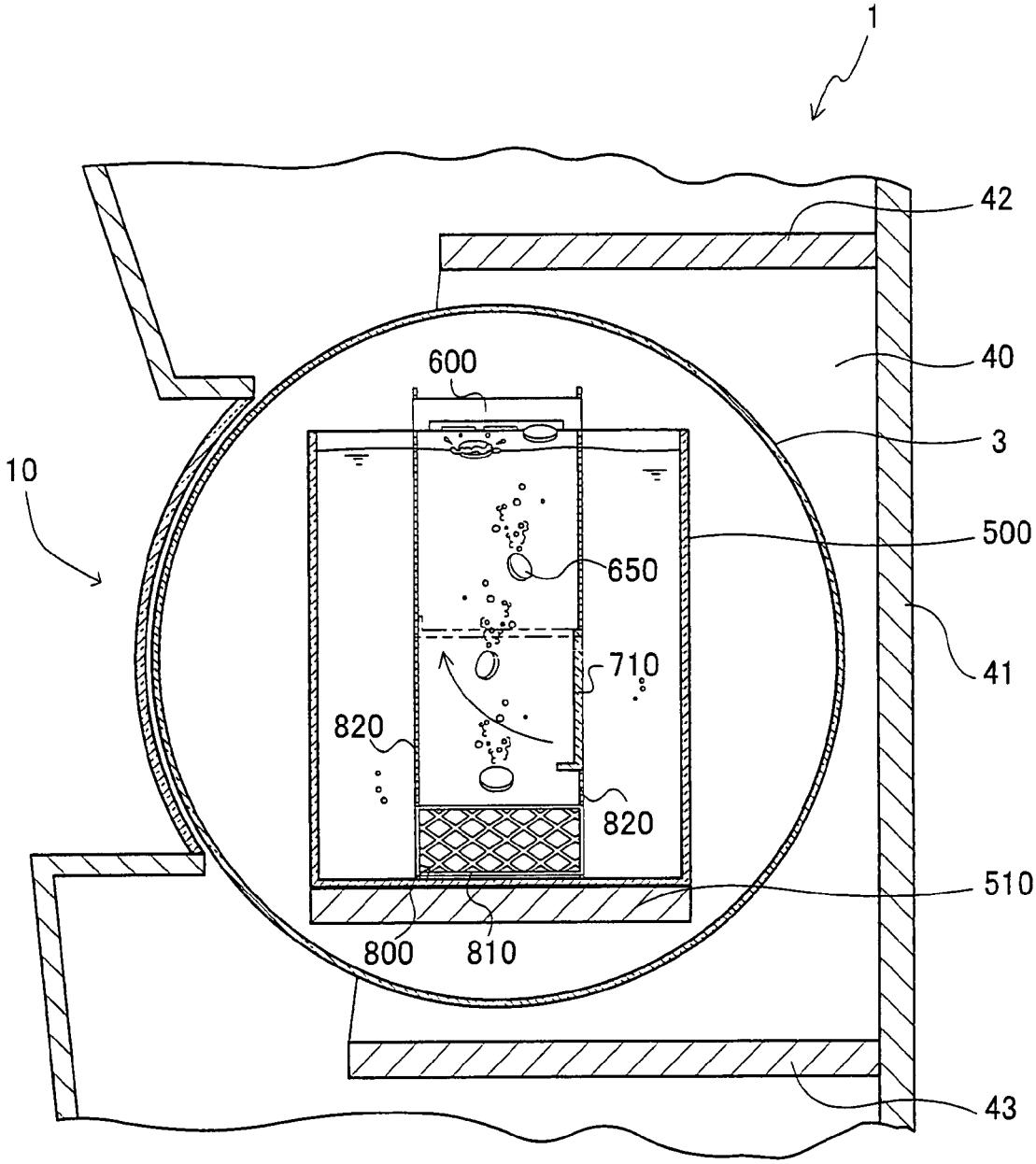
FIG. 3 is a cross-sectional view showing the reel group and the water tank included in the slot machine according to the first embodiment of the present invention.

FIG. 3 is a cross-sectional view showing the reel group 30 and the water tank 500 included in the slot machine 1 according to the first embodiment of the present invention.

Each of the mechanical reels 30A through 30C is independently rotatably supported by a reel frame 40. It should be noted that an unshown stepping motor is provided to the reel frame 40 for providing a function of rotating each of the mechanical reels 30A through 30C, and a function of stopping the rotation thereof. The reel frame 40 is provided between an upper frame 42 and a lower frame 43 provided to a main frame 41.

The water tank 500 is provided in the space within the three cylindrical mechanical reels 30A through 30C, and is supported by the cabinet of the slot machine 1 through a water tank frame 510. Here, the water tank 500 is formed substantially in the shape of a rectangular parallelepiped, and is formed of a translucent material which is capable of retaining liquid. It should be noted that the water tank 500 according to the present embodiment is not restricted to such an arrangement. Rather, the water tank 500 may be formed in a desired shape, e.g., substantially in the shape of a cylinder. Also, various kinds of items for providing visual effects may be arranged within the water tank 500 (examples of which include simulated pirate ships, simulated tropical fish, and simulated aquatic plants, all of which can be moved by magnetic force).

In other words, the water tank 500 is provided behind the display screen that serves as a display means for displaying the indicating information. Here, the water tank 500 is a water tank which is capable of retaining liquid, and is formed of a translucent material, for example.

The gaming effects gaming medium insertion device 600 is provided at the upper-left portion of the water tank 500. When a predetermined event occurs, the gaming effects gaming medium insertion device 600 inserts units of the gaming effects gaming medium 650 from the upper-left portion of the water tank 500 into and toward the central portion of the water tank 500. In other words, the gaming effects gaming medium insertion device 600 serves as an example of an insertion means for inserting units of the gaming effects gaming medium into the water tank.

The gaming effects gaming medium removal device 700 includes: a gaming effects gaming medium receiving plate unit 710 which is turnably provided in the water tank 500 such that it extends from the upper-right portion to the lower-left portion thereof; and a motor 720 which turns the gaming effects gaming medium receiving plate unit 710. With such an arrangement, the gaming effects gaming medium receiving plate unit 710 is provided within the water tank 500 such that it slopes from the upper-right portion to the lower-left portion thereof. The gaming effects gaming medium receiving plate unit 710 is formed of a translucent material, and includes a plate portion having a substantially planar surface for receiving units of the gaming effects gaming medium 650 inserted into the water tank 500 by the gaming effects gaming medium insertion device 600. A tab portion is provided on the edge of the plate portion, such that it extends along the direction substantially orthogonal to the direction along which the gaming effects gaming medium receiving plate unit 710 extends in the water tank 500. With such an arrangement, the gaming effects gaming medium receiving plate unit 710 is disposed such that its surface is substantially parallel to the vertical direction before the predetermined event occurs. When the predetermined event occurs, the motor 720 turns the gaming effects gaming medium receiving plate unit 710 by a predetermined angle with respect to the vertical direction.

The gaming effects gaming medium collection device 800 is provided on the right side face of the water tank 500. The gaming effects gaming medium collection device 800 includes: a basket unit 810, under the left end of the plate portion of the gaming effects gaming medium receiving plate unit 710, which collects units of the gaming effects gaming medium 650 that have been received by the gaming effects gaming medium receiving plate unit 710 of the gaming effects gaming medium removal device 700; and a transfer unit 820 which moves the basket unit 810 in the vertical direction along the left side wall of the water tank 500.

When the gaming effects gaming medium receiving plate unit 710 is turned by a predetermined angle with respect to the vertical direction, after units of the gaming effects gaming medium 650 have been inserted into the water tank 500 by the gaming effects gaming medium insertion device 600, the gaming effects gaming medium receiving plate unit 710 removes the units of the gaming effects gaming medium 650 from the water tank 500 as follows.

First, the plate portion of the gaming effects gaming medium receiving plate unit 710 receives the units of the gaming effects gaming medium 650 that are inserted into the water tank 500 by the gaming effects gaming medium insertion device 600. The tab portion of the gaming effects gaming medium receiving plate unit 710 serves as a stopper which prevents the units of the gaming effects gaming medium 650 received by the plate portion from directly dropping toward the bottom of the water tank 500. With such an arrangement, the units of the gaming effects gaming medium 650 thus received by the plate portion migrate along the plate portion from the upper-right portion to the lower-left portion of the water tank 500. As a result, the units of the gaming effects gaming medium 650 are collected by the basket unit 810 of the gaming effects gaming medium collection device 800, which is disposed under the left end of the plate portion of the gaming effects gaming medium receiving plate unit 710. Subsequently, the transfer unit 820 of the gaming effects gaming medium collection device 800 transfers the basket unit 810, within which the units of the gaming effects gaming medium 650 are stored, to the upper portion of the water tank 500. Then, the units of the gaming effects gaming medium 650 collected by the basket unit 810 are returned to the gaming effects gaming medium insertion device 600.

In other words, the gaming effects gaming medium removal device 700 serves as an example of a removal means for removing units of the gaming effects gaming medium from the interior of the water tank after they have been inserted into the water tank by the insertion means.

The retaining unit 900 is formed of a translucent material, is disposed at the bottom of the box-shaped water tank 500, and accumulatively retains units of the gaming effects gaming medium 650 that are inserted into the water tank by the gaming effects gaming medium insertion device 600. In other words, the retaining unit 900 serves as an example of a gaming effects retention means for retaining units of the gaming effects gaming medium in the water tank, which are inserted into the water tank by an insertion means.

Next, a description is provided regarding a configuration of the control device 100.

Figure 4:
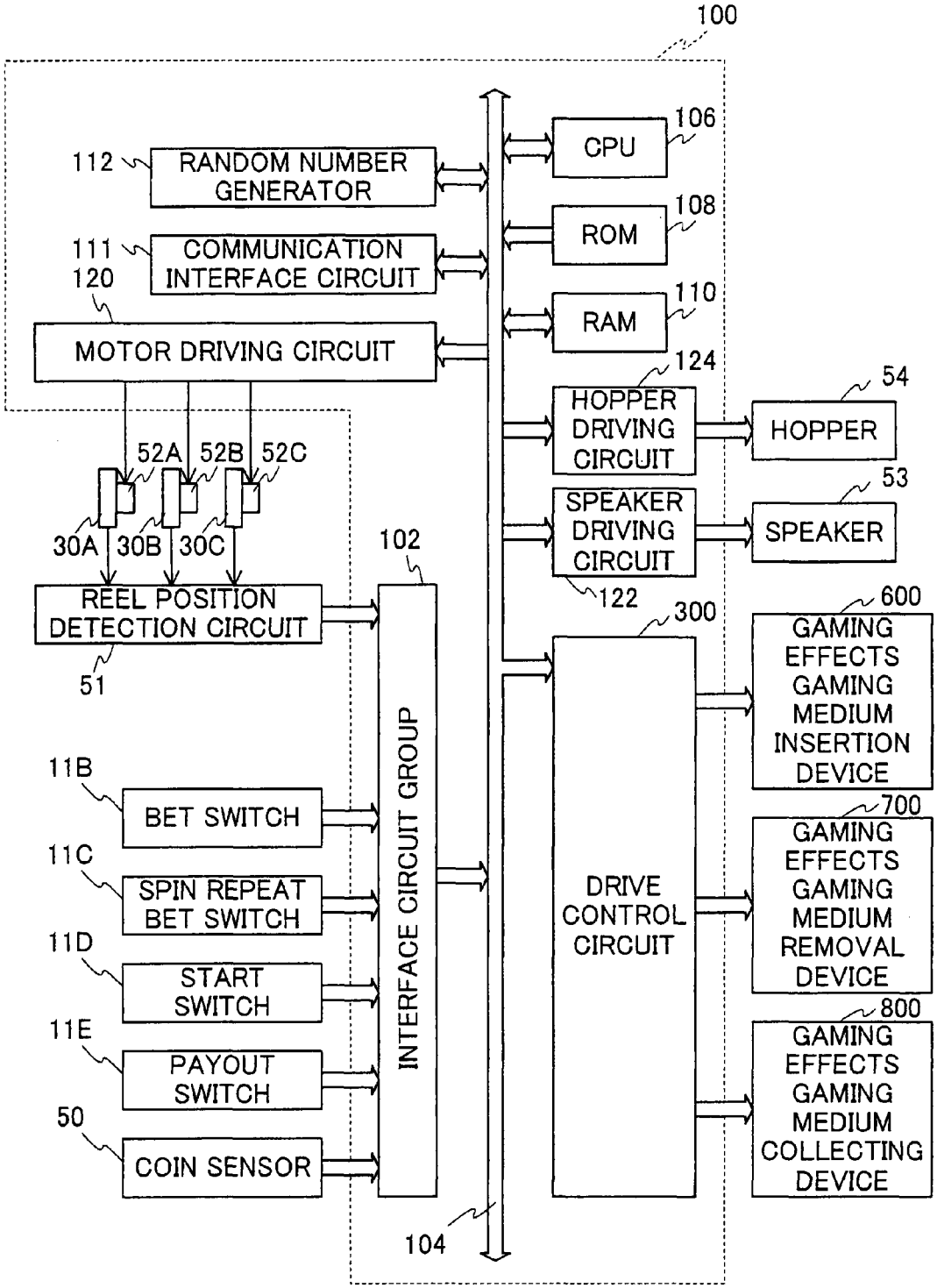
FIG. 4 is a block diagram showing an electrical configuration of a control device according to the first embodiment of the present invention.

FIG. 4 is a block diagram showing an electrical configuration of the control device 100 according to the first embodiment of the present invention.

The control device 100 is a microcomputer, and includes an interface circuit group 102, an input/output bus 104, a CPU 106, ROM 108, RAM 110, a communication interface circuit 111, a random number generator 112, a motor driving circuit 120, a speaker driving circuit 122, and a hopper driving circuit 124.

The interface circuit group 102 is connected to the input/output bus 104. Furthermore, the input/output bus 104 inputs and outputs data signals or address signals to and from the CPU 106.

The start switch 11D is connected to the interface circuit group 102. The start signal output from the start switch 11D is converted into a predetermined signal by the interface circuit group 102, and the start signal thus converted is sent to the input/output bus 104.

Furthermore, the BET switch 11B, the spin repeat BET switch 11C, and the payout switch 11E are connected to the interface circuit group 102. Each of the switching signals output from these switches 11B, 11C, and 11E is also sent to the interface circuit group 102, and is converted into a predetermined signal by the interface circuit group 102. The switching signals thus converted are sent to the input/output bus 104.

Furthermore, a coin sensor 50 is connected to the interface circuit group 102. The coin sensor 50 is a sensor for detecting the coins inserted into the coin insertion opening 11A. The coin sensor 50 is provided in combination with the coin insertion opening 11A. The sensing signal output from the coin sensor 50 is also sent to the interface circuit group 102, and is converted into a predetermined signal by the interface circuit group 102. The sensing signal thus converted is sent to the input/output bus 104.

Furthermore, a reel position detecting circuit 51 is connected to the interface circuit group 102. The reel position detecting circuit 51 is a circuit for detecting the rotational position for each of the mechanical reels 30A through 30C based upon the pulse signals received from a reel rotational position sensor (not shown). The detection signal output from the reel position detecting circuit 51 is also sent to the interface circuit group 102, and is converted into a predetermined signal by the interface circuit group 102. The detection signal thus converted is sent to the input/output bus 104.

Furthermore, the ROM 108 and the RAM 110 are connected to the input/output bus 104.

According to a program stored in the ROM 108, which is described later in detail, the CPU 106 controls the execution of a game provided by the slot machine 1.

The ROM 108 stores: a control program which centrally controls the slot machine 1; initialization data for executing the control program; a gaming medium removal table which is used by the drive control circuit 300 for controlling the driving of the gaming effects gaming medium removal device 700; and various data tables used for advancing the game. The data table thus stored includes: the gaming medium payout values used in the gaming medium payout operation; the quantity of the gaming effects gaming medium 650 (see FIG. 2) to be inserted into the water tank 500 (see FIG. 2) by the gaming effects gaming medium insertion device 600 according to the determination that the game state is to be switched to a game state advantageous to the player. Here, the quantity of the gaming effects gaming medium 650 to be inserted into the water tank 500, which is thus stored in the ROM 108, corresponds to a part of the gaming medium payout value. In addition, the data table stores the quantity (e.g., 100 units) of the gaming effects gaming medium 650 (see FIG. 2) to be inserted into the water tank 500 (see FIG. 2) by the gaming effects gaming medium insertion device 600 according to the determination that the game state is to be switched to a special game state.

The RAM 110 temporarily stores flags, variables, etc., used for the aforementioned control program. Furthermore, the RAM 110 stores: a gaming medium payout counter that stores the gaming medium payout amount used in the processing in which, if the game state is switched to a special game state advantageous to the player, a predetermined amount of the gaming medium is paid out; and a jackpot counter which accumulatively stores a portion deducted from the gaming medium payout amount which is used in the processing in which a predetermined amount of the gaming medium is paid out.

Furthermore, a communication interface circuit 111 is connected to the input/output bus 104. The communication interface circuit 111 is a circuit for communicating with a server, etc., via various kinds of communication networks including a public telephone line network, LAN, etc.

Furthermore, the random number generator 112 for generating a random number is connected to the input/output bus 104. The random number generator 112 generates a random number in a predetermined range, e.g., in a range of 0 and 65535. Alternatively, an arrangement may be made in which the CPU 106 generates a random number by computation.

A motor driving circuit 120 for driving the stepping motors 52A through 52C is connected to the input/output bus 104. The CPU 106 controls the operations of the stepping motors 52A through 52C via the motor driving circuit 120 according to the occurrence of predetermined events.

Furthermore, the speaker driving circuit 122 for driving the speaker 53 is connected to the input/output bus 104. The CPU 106 reads out the sound data stored in the ROM 108, and transmits the sound data thus read out to the speaker driving circuit 122 via the input/output bus 104, thereby providing predetermined sound effects generated by the speaker 53.

Furthermore, the hopper driving circuit 124 for driving the hopper 54 is connected to the input/output bus 104. Upon reception of a cash out signal input from the payout switch 11E, the CPU 106 transmits a drive signal to the hopper driving circuit 124 via the input/output bus 104. The hopper 54 then proceeds to pay out an amount of coins that corresponds to the credits remaining at the current point in time, as stored in a predetermined memory area of the RAM 110. In other words, the hopper 54 serves as an example of a payout means for paying out units of a gaming medium.

Furthermore, the components connected to the input/output bus 104 include the drive control circuit 300, which controls the gaming effects gaming medium insertion device 600, the gaming effects gaming medium removal device 700, and the gaming effects gaming medium collection device 800.

When a predetermined event occurs, the CPU 106 transmits a signal to the drive control circuit 300, which instructs the gaming effects gaming medium insertion device 600 to insert a predetermined quantity of the gaming effects gaming medium 650 (see FIG. 2). The drive control circuit 300 performs a control operation which instructs the gaming effects gaming medium insertion device 600 to insert a quantity of the gaming effects gaming medium 650 into the water tank 500 according to the signal thus received.

When a predetermined event occurs, the CPU 106 transmits a signal to the drive control circuit 300, which is an instruction to turn the gaming effects gaming medium receiving plate unit 710 (see FIG. 2) of the gaming effects gaming medium removal device 700 by a predetermined angle. The drive control circuit 300 controls the driving of the motor 720 of the gaming effects gaming medium removal device 700, thereby controlling the gaming effects gaming medium receiving plate unit 710 such that it is turned by a predetermined angle according to this signal.

When a predetermined event occurs, the CPU 106 transmits a signal to the drive control circuit 300, which is an instruction to drive the basket unit 810 (see FIG. 2) of the gaming effects gaming medium collection device 800 in the vertical direction. The drive control circuit 300 performs a control operation which drives the basket unit 810 in the vertical direction according to the signal thus received.

Figure 5:
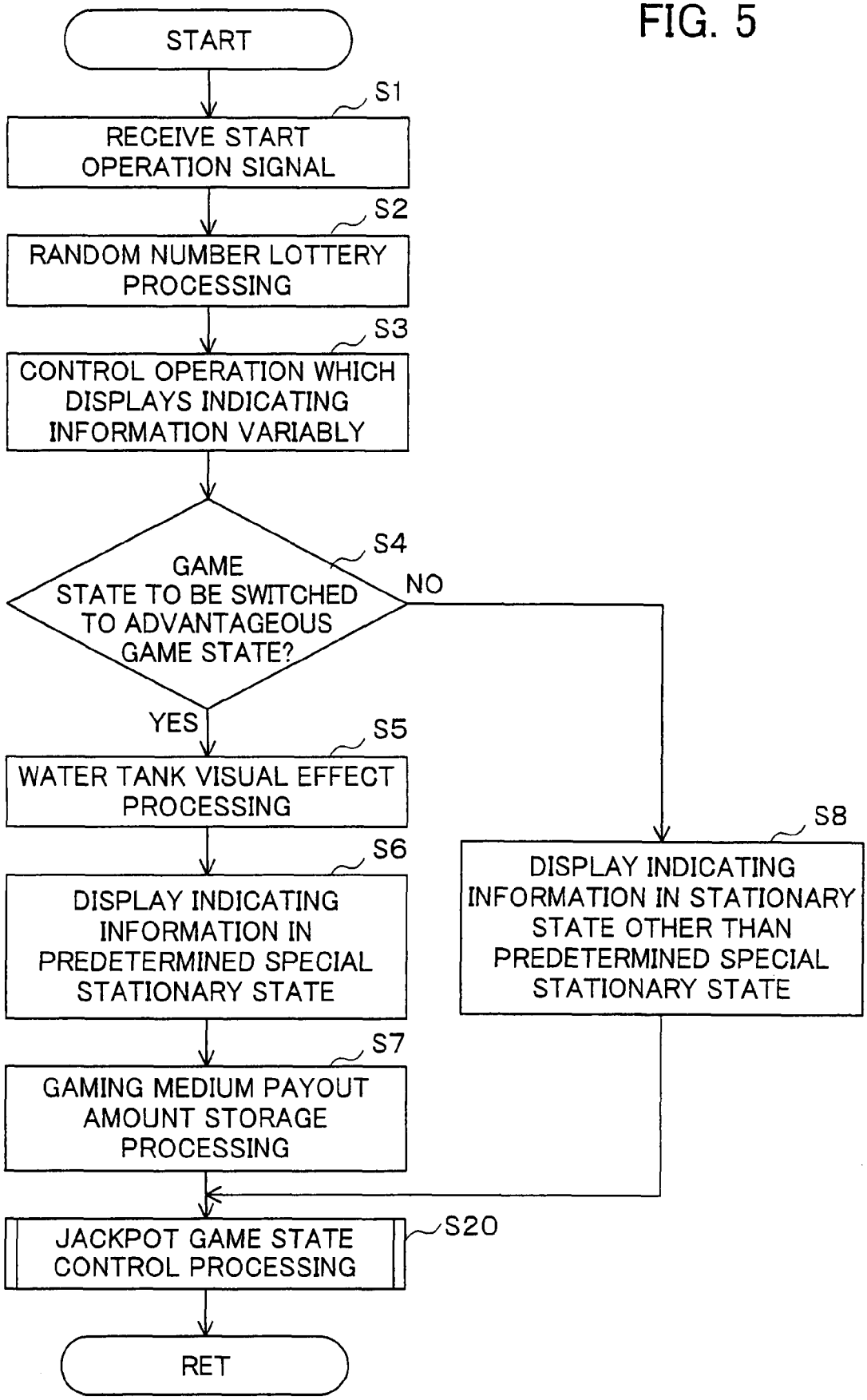
FIG. 5 is a flowchart for the game control means included in the slot machine according to the embodiment of the present invention.

Next, a description is provided regarding the operation of the CPU 106 that controls the execution of a game provided by the slot machine 1 according to the first embodiment with reference to a flowchart shown in FIG. 5.

In step S1, the CPU 106 receives a start operation signal. In this processing, upon the player performing a pushing operation on either the spin repeat BET switch 11C or the start switch 11D, a start operation signal is transmitted, upon which the CPU 106 receives the start operation signal thus transmitted. Upon completion of this processing, the CPU 106 switches the processing to step S2.

In step S2, the CPU 106 performs random number lottery processing. In this processing, the CPU 106 instructs the random number generator 112 to generate a random number, and extracts the random number thus generated. Upon completion of this processing, the CPU 106 switches the processing to step S3.

In step S3, the CPU 106 performs indicating information variable display control processing. In this processing, the CPU 106 transmits a command which instructs the motor driving circuit 120 to rotate the mechanical reels 30A through 30C. Upon reception of this command, the motor driving circuit 120 performs a control operation so as to rotate the mechanical reels 30A through 30C. In other words, the motor driving circuit 120 serves as an example of a display control means which is a rotational driving device for driving the reels. Upon completion of this processing, the CPU 106 switches the processing to step S4.

In step S4, the CPU 106 determines whether or not the game state is to be switched to an advantageous game state. In this processing, the CPU 106 determines whether or not the random number thus extracted in step S2 is within a predetermined range. In a case where the CPU 106 determines that the random number is within the predetermined range, the CPU 106 determines that the game state is to be switched to the advantageous game state, upon which the processing is switched to step S5. On the other hand, in a case where the CPU 106 does not determine that the random number is within the predetermined range, the CPU 106 determines that the game state is not to be switched to the advantageous game state, upon which the processing is switched to step S6.

In other words, the CPU 106 provides: a function as an operating means for allowing the player to operate the slot machine 1; and a function as an example of a game control means for determining, for every instance of the player performing an operation via the operating means, whether or not the game state is to be switched to the game state that is advantageous to the player.

The term "game state advantageous to the player" represents a state in which the following conditions are satisfied. First, in the processing in step S5 described later, the indicating information depicted on the mechanical reels 30A through 30C are displayed on the display screen 10 in a predetermined stationary display state (e.g., the indicating information "red 7", "red 7", and "red 7" are rearranged in the stationary display state). Second, in the processing in step S7 described later, a gaming medium payout amount is stored in the gaming medium payout counter in the RAM 110, which is used in payout processing in which a predetermined amount of the gaming medium is paid out. When the player performs a pushing operation on the payout switch 11E (see FIG. 1), an amount of the gaming medium is paid out according to the amount stored in the gaming medium payout counter.

In step 5, the CPU 106 performs water tank gaming effects control processing. In this processing, the CPU 106 transmits a signal to the drive control circuit 300 according to the determination made in step S4, which is an instruction to insert a quantity of the gaming effects gaming medium 650 (see FIG. 2) that corresponds to a portion of a predetermined amount of the gaming medium to be paid out. The drive control circuit 300 performs a control operation which instructs the gaming effects gaming medium insertion device 600 to insert a quantity of the gaming effects gaming medium 650 into the water tank 500 according to this signal. In other words, the drive control circuit 300 serves as an insertion control means having a function whereby, in a case where the game control means has determined that the game state is to be switched to a game state advantageous to the player, the insertion means is instructed to insert into the water tank a quantity of the gaming effects gaming medium which corresponds to a portion of the predetermined amount of the gaming medium to be paid out via the payout means. Upon completion of this processing, the CPU 106 switches the processing to step S6.

In step S6, the CPU 106 performs a control operation so as to display the indicating information in a predetermined special stationary state. In this processing, the CPU 106 transmits a command which is an instruction to the motor driving circuit 120 to display the indicating information depicted on the mechanical reels 30A through 30C on the display screen 10 in a predetermined special stationary state (e.g., the indicating information "red 7", "red 7", and "red 7" are rearranged in the stationary state). Upon reception of this command, the motor driving circuit 120 performs a control operation so as to display the indicating information depicted on the mechanical reels 30A through 30C on the display screen 10 in the predetermined special stationary state (e.g., the indicating information "red 7", "red 7", and "red 7" are rearranged in the stationary state). Upon completion of this processing, the CPU 106 switches the processing to step S8.

In step S7, the CPU 106 performs gaming medium payout amount storage processing. In this processing, the CPU 106 stores the gaming medium payout amount, which is used in the processing in which a predetermined amount of the gaming medium is paid out, in the gaming medium payout counter in the RAM 110, according to the determination made in step S4 that the game state is to be switched to a special game state advantageous to the player. Furthermore, the CPU 106 deducts a portion from the gaming medium payout amount which is used in the processing in which a predetermined amount of the gaming medium is paid out. The portion thus deducted is accumulatively stored in the RAM 110 as the jackpot counter value. Upon completion of this processing, the CPU 106 performs jackpot game state control processing (step S20) described later, upon which one game ends.

In other words, the CPU 106 serves as an example of a payout control means for performing a control operation which instructs the payout means to pay out a predetermined amount of the gaming medium according to the determination of whether or not the game state is to be switched to a special game state advantageous to the player. Furthermore, the RAM 110 serves as an example of a storage means for storing a portion deducted from the gaming medium payout amount which is used in the payout operation of the payout control means for paying out a predetermined amount of the gaming medium. Upon completion of this processing, the CPU 106 performs jackpot game state control processing (step S20) described later, upon which one game ends.

The drive control circuit 300 performs a control operation which instructs the gaming effects gaming medium insertion device 600 to insert into the water tank 500 a quantity of the gaming effects gaming medium that corresponds to a portion of a predetermined amount of the gaming medium which is retained by the retention means and is to be paid out according to an instruction from the payout control means. That is to say, the drive control circuit 300 serves as an example of an insertion control means for performing a control operation which instructs the insertion means to insert a quantity of the gaming effects gaming medium into the water tank according to the amount of the gaming medium retained by the retention means.

In step S8, the CPU 106 performs a control operation which displays the indicating information in a stationary display state other than the predetermined special stationary display state. In this processing, the CPU 106 transmits a command to the motor driving circuit 120, which is an instruction to display the indicating information, which is provided by the mechanical reels 30A through 30C, on the display screen 10 in a stationary display state other than the predetermined special stationary display state (e.g., other than the state in which the indicating information "red 7", "red 7", and "red 7" are rearranged in the stationary display state). Upon reception of this command, the motor driving circuit 120 performs a control operation which displays the indicating information, which is provided by the mechanical reels 30A through 30C, on the display screen 10 in a stationary display state other than the predetermined special stationary display state. Upon completion of this processing, the CPU 106 performs the jackpot game state control processing (step S20) described later, upon which one game ends.

In other words, the CPU 106 serves as an example of a game control means for controlling the execution of a game.

Figure 6:
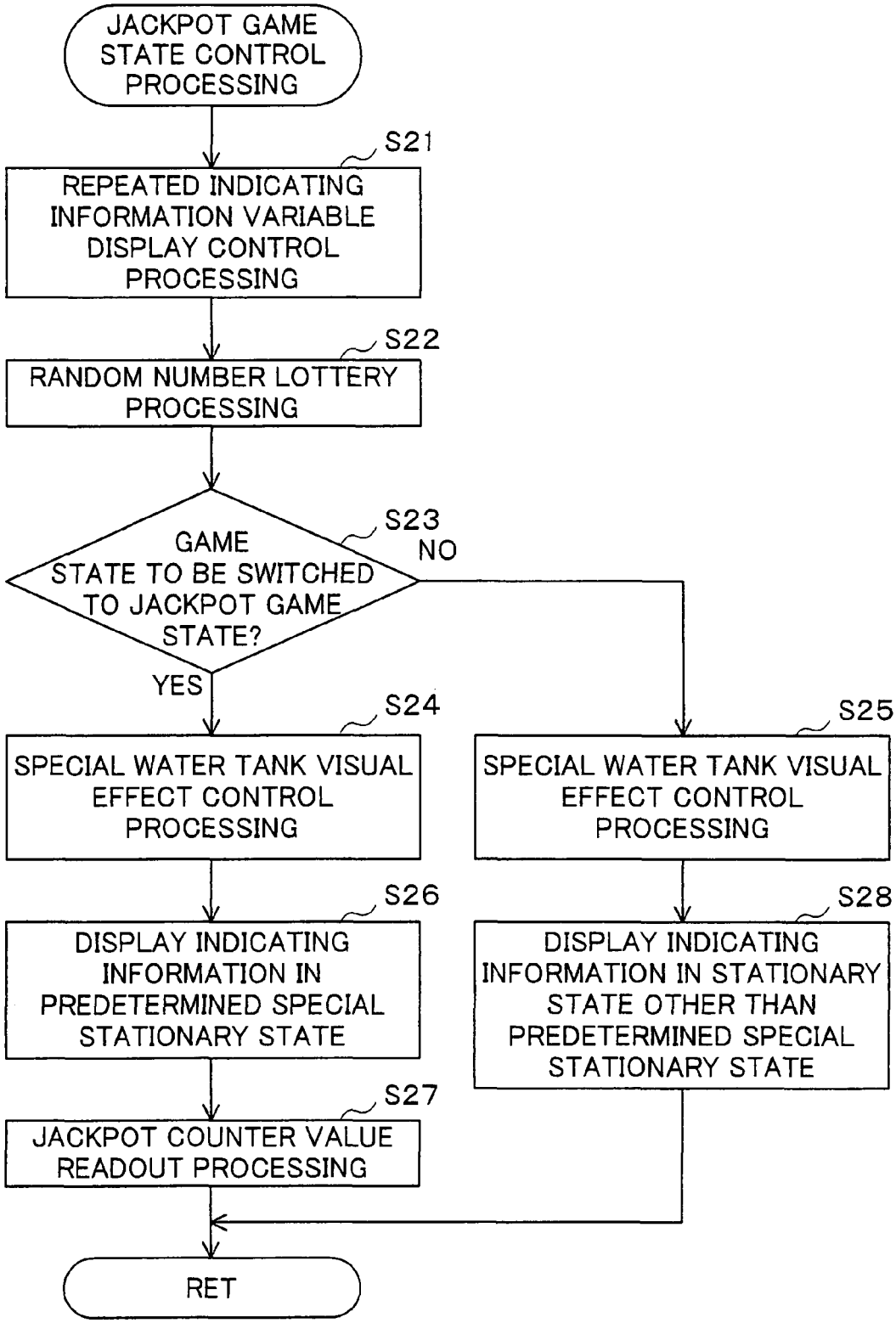
FIG. 6 is a flowchart for the game control means included in the slot machine according to the embodiment of the present invention.

Next, a description is provided, with reference to the flowchart shown in FIG. 6, regarding the jackpot game state control processing denoted by step S20 shown in FIG. 5, which is performed by the CPU 106 that controls the execution of the game provided by the slot machine 1, according to the first embodiment.

In step S21, the CPU 106 performs repeated indicating information variable display control processing. In this processing, the CPU 106 transmits a command to the motor driving circuit 120, which is an instruction to rotate the mechanical reels 30A through 30C. Upon reception of this command, the motor driving circuit 120 performs a control operation which rotates the mechanical reels 30A through 30C. Upon completion of this processing, the CPU 106 switches the processing to step S22.

In step S22, the CPU 106 performs random number lottery processing. In this processing, the CPU 106 instructs the random number generator 112 to generate a random number, and extracts the random number thus generated. Upon completion of this processing, the CPU 106 switches the processing to step S23.

In step S23, the CPU 106 determines whether or not the game state is to be switched to a jackpot game state. In this processing, the CPU 106 determines whether or not the random number extracted in the processing denoted by step S22 is within a predetermined range. If the CPU 106 determines that the random number thus extracted is within the predetermined range, the CPU 106 determines that the game state is to be switched to the jackpot game state, upon which the flow proceeds to step S24. On the other hand, if the CPU 106 determines that the random number thus extracted is not within the predetermined range, the CPU 106 determines that the game state is not to be switched to the jackpot game state, upon which the flow proceeds to step S25.

In other words, the CPU 106 serves as an example of a jackpot game control means for providing a function whereby, when the player performs an operation on an operating means, a special determination is made whether or not the game state is to be switched to a jackpot game state advantageous to the player.

The term "jackpot game state" represents the state in which the following conditions are satisfied. First, in the processing in step S26 described later, the indicating information depicted on the mechanical reels 30A through 30C are displayed on the display screen 10 in a predetermined stationary display state (e.g., the indicating information "bell", "bell", and "bell" are rearranged in the stationary display state). Second, in the processing in step S7 described later, the value stored as the jackpot counter value is read out from the RAM 110, and the value thus read out is stored in the RAM 110 as the game medium payout counter value. When the player performs a pushing operation on the payout switch 11E (see FIG. 1), an amount of the gaming medium is paid out according to the amount stored as the gaming medium payout counter value.

In step S24 and step S25, the CPU 106 performs special water tank gaming effects control processing. In this processing, the CPU 106 transmits a signal to the drive control circuit 300 according to the determination made in step S23, which instructs the gaming effects gaming medium insertion device 600 to insert a quantity of the gaming effects gaming medium 650 (see FIG. 2) that corresponds to the value stored in the data table stored in the ROM 108. The drive control circuit 300 performs a control operation which instructs the gaming effects gaming medium insertion device 600 to insert a quantity of the gaming effects gaming medium 650 according to the signal thus received.

In other words, the drive control circuit 300 serves as an example of an insertion control means for performing a control operation which instructs the insertion means to insert a quantity of the gaming effects gaming medium into the water tank according to a special determination made by a special game control means.

Furthermore, in step S24 and step S25, the CPU 106 transmits another signal to the drive control circuit 300 according to the determination made in step S23, which is an instruction to turn the gaming effects gaming medium receiving plate unit 710 (see FIG. 2) of the gaming effects gaming medium removal device 700 by a predetermined angle with reference to the gaming effects gaming medium removal table (see FIG. 7) stored in the ROM 108. The drive control circuit 300 controls the driving of the motor 720 of the gaming effects gaming medium removal device 700, thereby performing a control operation which turns the gaming effects gaming medium receiving plate unit 710 by a predetermined angle according to the signal thus received. Upon completion of this processing, the CPU 106 switches the processing to step S26 or step S28.

In other words, the drive control circuit 300 serves as an example of a removal control means for controlling the removal means according to a special determination made by the special game control means.

In step S26, the CPU 106 performs a control operation, which displays the indicating information in a predetermined stationary display state. In this processing, the CPU 106 transmits a command to the motor driving circuit 120, which is an instruction to display the indicating information depicted on the mechanical reels 30A through 30C on the display screen 10 in a predetermined stationary display state (e.g., the indicating information "bell", "bell", and "bell" are rearranged in the stationary display state). Upon reception of this command, the motor driving circuit 120 performs a control operation which displays on the display screen 10 the indicating information depicted on the mechanical reels 30A through 30C in the predetermined stationary display state (e.g., the indicating information "bell", "bell", and "bell" are rearranged in the stationary display state). Upon completion of this processing, the CPU 106 switches the processing to step S27.

In step S27, the CPU 106 performs jackpot counter value readout processing. In this processing, according to the determination made in the processing denoted by step S23 that the game state is to be switched to the jackpot game state, the CPU 106 reads out the jackpot counter value, and stores the value thus read out in the RAM 110 as the game medium payout counter value.

In other words, the CPU 106 serves as an example of a payout control means for providing a function whereby, if the jackpot game control means has made a special determination that the game state is to be switched to the jackpot game state, the payout means is instructed to pay out the amount of the gaming medium retained in the retention means. Upon completion of this processing, the CPU 106 completes the jackpot game state control processing.

In step S27, the CPU 106 performs a control operation which displays the indicating information in a stationary display state other than the predetermined special stationary display state. In this processing, the CPU 106 transmits a command to the motor driving circuit 120, which is an instruction to display on the display screen 10 the indicating information depicted on the mechanical reels 30A through 30C in a stationary display state other than the predetermined special stationary display state (e.g., other than the state where the indicating information "bell", "bell", and "bell" are rearranged in the stationary display state). Upon reception of this command, the motor driving circuit 120 performs a control operation which displays the indicating information depicted on the mechanical reels 30A through 30C on the display screen 10 in a stationary display state other than the predetermined special stationary display state. Upon completion of this processing, the CPU 106 ends the jackpot game state control processing.

Next, a description is provided regarding the gaming medium removal table used by the CPU 106 as a reference in the processing denoted by the aforementioned step S24 and step S25.

FIG. 7 shows the gaming effects gaming medium removal table.

The ROM 108 stores the gaming effects gaming medium removal table that specifies the relation between the probability that the game state will transit to the special game state and the angle by which the gaming effects gaming medium receiving plate unit 710 of the gaming effects gaming medium removal device 700 is to be turned. Specifically, in a case where the probability that the game state will transit to the jackpot game state is 100%, the gaming effects gaming medium receiving plate unit 710 is not turned. In a case where the probability that the game state will transit to the jackpot game state is 80%, the gaming effects gaming medium receiving plate unit 710 is turned left 45°. In a case where the probability that the game state will transit to the jackpot game state is 30%, the gaming effects gaming medium receiving plate unit 710 is turned 90°.

Next, a description is provided regarding the water tank gaming effects processing provided by the slot machine 1 according to the first embodiment of the present invention.

Figure 8:
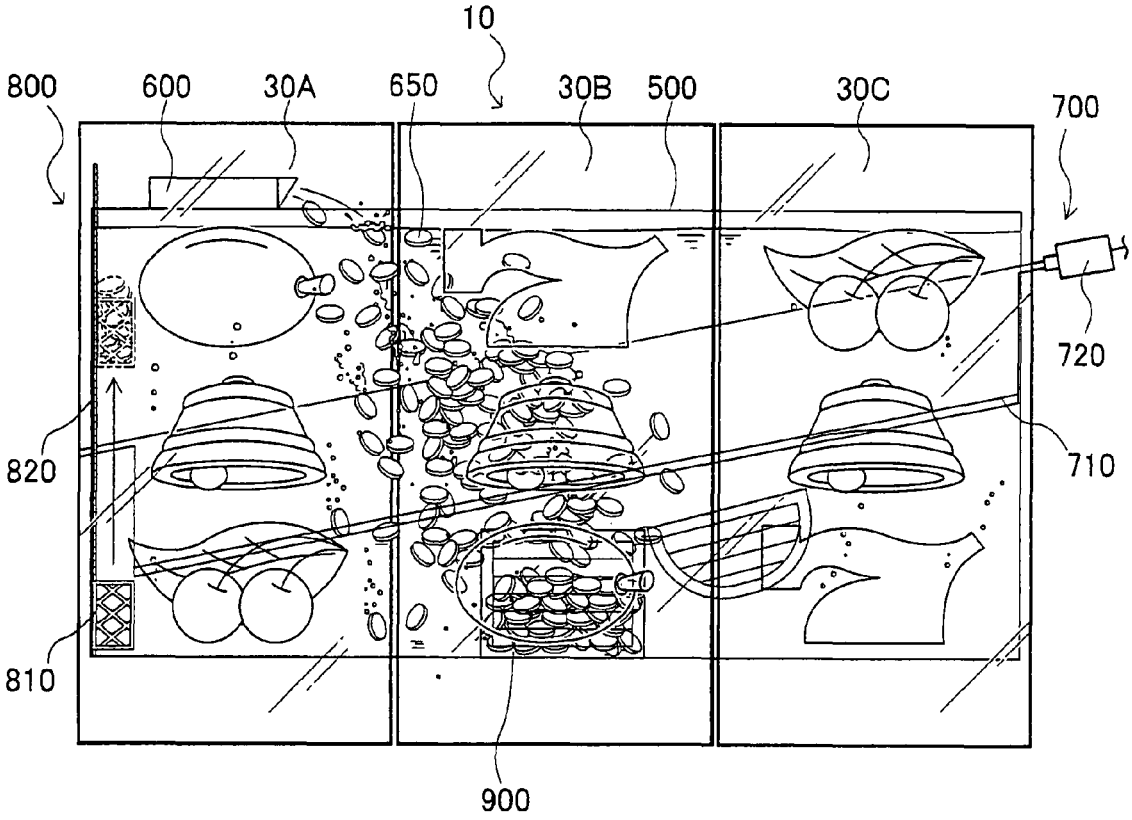
FIG. 8 is a front view showing the reel group, the water tank, the gaming effects gaming medium insertion means, the gaming effects gaming medium removal device, the gaming effects gaming medium collection device, and the retaining unit, included in the slot machine according to the first embodiment of the present invention.
Figure 9:
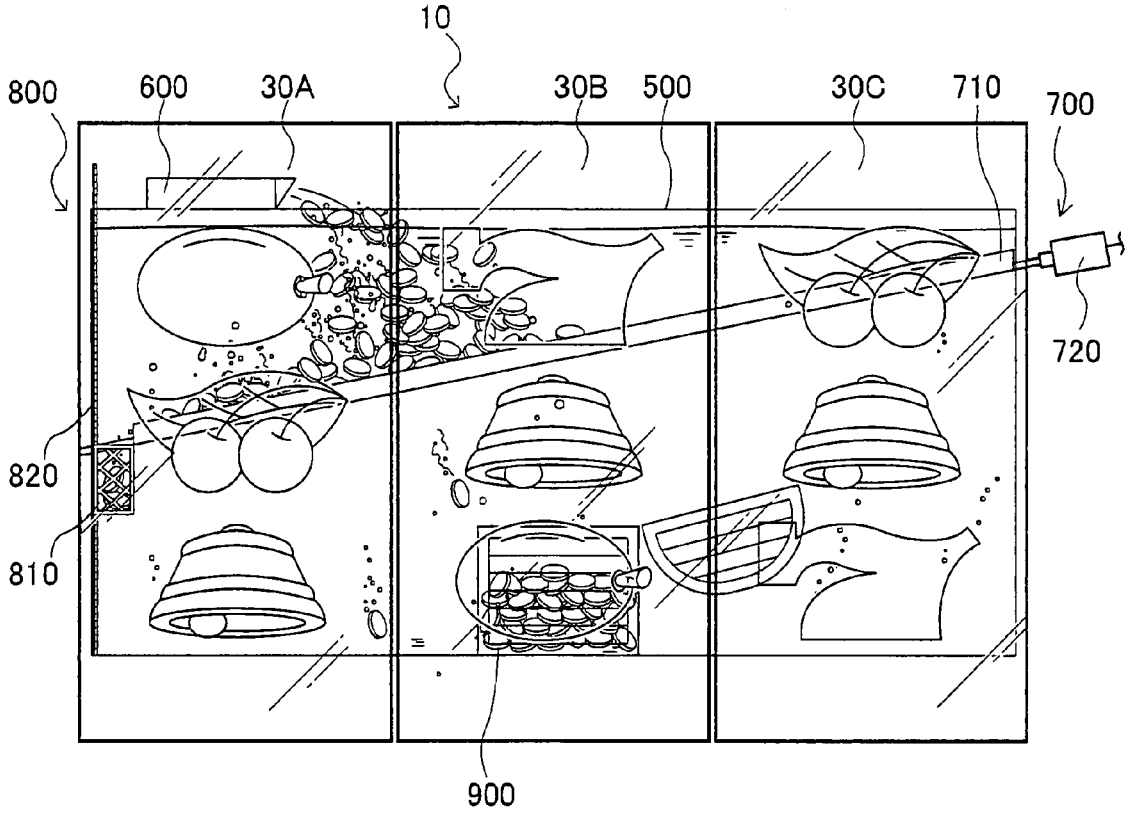
FIG. 9 is a front view showing the reel group, the water tank, the gaming effects gaming medium insertion means, the gaming effects gaming medium removal device, the gaming effects gaming medium collection device, and the retaining unit, included in the slot machine according to the first embodiment of the present invention.

FIG. 8 and FIG. 9 are front views showing the reel group 30, the water tank 500, the gaming effects gaming medium insertion device 600, the gaming effects gaming medium removal device 700, the gaming effects gaming medium collection device 800, and the retaining unit 900, which are included in the slot machine 1 according to the first embodiment of the present invention.

Next, FIG. 8 shows the indicating information provided on the mechanical reels 30A through 30C, displayed via the display screen 10 in a predetermined special stationary display state (e.g., the indicating information "bell", "bell", and "bell" are rearranged in the stationary display state). In this stage, the gaming effects gaming medium insertion device 600 inserts into the water tank 500 a quantity of the gaming effects gaming medium 650 corresponding to the value stored in the data table in the ROM 108 (see FIG. 4) under the control of the drive control circuit 300 (see FIG. 4). The units of the gaming effects gaming medium 650 thus inserted into the water tank 500 by the gaming effects gaming medium insertion device 600 are retained in the retaining unit 900. Furthermore, the drive control circuit 300 (see FIG. 4) controls the gaming effects gaming medium removal device 700 with reference to the gaming effects gaming medium removal table (see FIG. 7) stored in the ROM 108 (see FIG. 4), such that the gaming effects gaming medium receiving plate unit 710 (see FIG. 2) of the gaming effects gaming medium removal device 700 is not turned.

Next, FIG. 9 shows the indicating information provided on the mechanical reels 30A through 30C, displayed via the display screen 10 in a stationary display state (e.g., the indicating information "cherry", "bell", and "bell" are rearranged in the stationary display state) other than the predetermined special stationary display state. In this stage, the gaming effects gaming medium insertion device 600 inserts into the water tank 500 a quantity of the gaming effects gaming medium 650 corresponding to the value stored in the data table in the ROM 108 (see FIG. 4) under the control of the drive control circuit 300 (see FIG. 4). Furthermore, the drive control circuit 300 (see FIG. 4) controls the gaming effects gaming medium removal device 700 with reference to the gaming effects gaming medium removal table (see FIG. 7) stored in the ROM 108 (see FIG. 4) so as to turn the gaming effects gaming medium receiving plate unit 710 (see FIG. 2) of the gaming effects gaming medium removal device 700 by 90°. In this state, the units of the gaming effects gaming medium 650 thus inserted into the water tank 500 by the gaming effects gaming medium insertion device 600 are removed from the central portion to the left side of the water tank 500 through the plate portion of the gaming effects gaming medium receiving plate unit 710 without dropping to the bottom of the water tank 500.

The first embodiment provides the following advantages.

(1) When the player performs an operation on either the spin repeat BET switch 11C or the start switch 11D, the CPU 106 determines whether or not the game state is to be switched to a special game state advantageous to the player. The mechanical reels 30A through 30C, each of which is formed of a translucent material, provide a function of displaying multiple kinds of indicating information variably and statically. According to the determination made by the CPU 106, the motor driving circuit 120 controls the display operation of the mechanical reels 30A through 30C on which multiple kinds of indicating information are displayed variably and statically. The water tank 500, which retains liquid and is formed of a translucent material, is provided behind the display screen 10 for displaying the indicating information provided on the mechanical reels 30A through 30C.

With such an arrangement, the water tank 500, which retains liquid, is provided behind the mechanical reels 30A through 30C that display multiple kinds of indicating information variably and statically. Such an arrangement allows the player to simultaneously recognize the multiple kinds of indicating information, which are provided on the mechanical reels 30A through 30C and are displayed on the display screen 10, and the water tank 500 provided behind the display screen 10. With such an arrangement, there is no need to take into account a concern of whether or not the water tank 500 interrupts the player's view of the display screen 10 that displays the indicating information depicted on the mechanical reels 30A through 30C. Thus, with such an arrangement, the depth dimension of the water tank 500 can be greater as compared with an arrangement in which the water tank 500 is provided forward of the mechanical reels 30A through 30C. Various kinds of items which provide visual effects (e.g., simulated pirate ships, simulated tropical fish, and simulated aquatic plants, all of which can be moved by magnetic force) can be arranged within such a water tank 500 thus designed.

Furthermore, when the player performs an operation on either the spin repeat BET switch 11C or the start switch 11D, the CPU 106 makes a special determination of whether or not the game state is to be switched to a jackpot game state advantageous to the player. The CPU 106 performs a control operation according to the determination thus made, which instructs the hopper 54 to pay out a predetermined amount of the gaming medium. The CPU 106 deducts a portion from the gaming medium payout amount which is used in the processing in which a predetermined amount of the gaming medium is paid out. The portion thus deducted is accumulatively stored as the jackpot counter in the RAM 110. In a case where a special determination has been made that the game state is to be switched to the jackpot game state, the CPU 106 reads out the jackpot counter value stored in the RAM 110, and stores the value thus read out in the RAM 110 as the gaming medium payout counter value. When the player performs a pushing operation on the payout switch 11E (see FIG. 1), the CPU 106 performs a control operation which pays out an amount of the gaming medium according to the value stored as the gaming medium payout counter value.

The drive control circuit 300 performs a control operation according to the special determination made by the CPU 106, which instructs the gaming effects gaming medium insertion device 600, which has a function of inserting units of the gaming effects gaming medium 650 into the water tank 500, to insert units of the gaming effects gaming medium 650 into the water tank 500.

With such an arrangement, in a case where a special determination has been made that the game state is to be switched to a jackpot game state (the so-called jackpot), an amount of the gaming medium is paid out according to the jackpot counter value accumulatively stored in the RAM 110.

Furthermore, such an arrangement has a function of inserting units of the gaming effects gaming medium 650 into the water tank 500, which serves as a notice that the game state will transit to the jackpot game state (jackpot).

As described above, such an arrangement provides a function of displaying the indicating information provided on the mechanical reels 30A through 30C variably and statically according to the determination made by the CPU 106 of whether or not the game state is to be switched to a special game state advantageous to the player, and a function of providing visual effects using the water tank 600 according to this determination, which notifies the player that the game state will transit to the jackpot game state (jackpot). Thus, with such an arrangement, visual effects, including the display of indicating information variably and statically, and the insertion of units of the gaming effects gaming medium 650 into the water tank 500, are displayed in a superimposed manner. The player is thereby provided with notice that the game state will transit to a special game state advantageous to the player or the jackpot game state (jackpot), which is of great interest to the player. This improves visual effects provided by the water tank 500.

Thus, such an arrangement provides improved visual effects by using the water tank 500, while facilitating the player's ability to visually recognize the information displayed by the mechanical reels 30A through 30C.

(2) The drive control circuit 300 performs a control operation which instructs the gaming effects gaming medium removal device 700 to remove the units of the gaming effects gaming medium 650, which have been inserted into the water tank 500, from the interior of the water tank 500 according to the special determination made by the CPU 106.

Such an arrangement provides a function of removing, according to the special determination of whether or not the game state is to be switched to the jackpot game state (jackpot), the units of the gaming effects gaming medium 650 thus inserted into the water tank 500 by the gaming effects gaming medium insertion device 600.

With such an arrangement, the CPU 106 determines by random number lottery whether or not the game state is to be switched to a jackpot game state (jackpot), upon which the drive control circuit 300 performs a control operation which instructs the gaming effects gaming medium removal device 700 to remove a quantity of the gaming effects gaming medium 650 with reference to the gaming medium removal table according to the special determination of whether or not the game state is to be switched to the jackpot game state advantageous to the player. The ROM 108 is provided for storing the gaming medium removal table that specifies the relation between the probability that the game state will transit to the jackpot game state, which is used in the random number lottery processing, and the angle by which the gaming effects gaming medium receiving plate unit 710 of the gaming effects gaming medium removal device 700 is to be turned. In the gaming medium removal table, the angle by which the gaming effects gaming medium receiving plate unit 710 is to be turned is inversely proportional to the probability that the game state will transit to the jackpot game state. With such an arrangement, the quantity of the gaming effects gaming medium removed by the gaming effects gaming medium removal device 700 becomes smaller as the probability that the game state will transit to the jackpot game state becomes higher. With such an arrangement, the quantity of the gaming effects gaming medium 650 removed by the gaming effects gaming medium removal device 700 further enhances the player's sense of expectation with respect to the game state transition to the jackpot game state advantageous to the player.

Thus, such an arrangement provides improved game effects by using the water tank 500, while facilitating the player's ability to visually recognize the information displayed on the mechanical reels 30A through 30C.

(3) The retaining unit 900 provided in the water tank 500 retains the units of the gaming effects gaming medium 650 inserted into the water tank 500 by the gaming effects gaming medium insertion device 600. The drive control circuit 300 instructs the gaming effects gaming medium insertion device 600 to insert a quantity of the gaming effects gaming medium into the water tank 500 according to the value accumulatively stored as the jackpot counter value in the RAM 110.

With such an arrangement, the quantity of the gaming effects gaming medium 650 retained by the retaining unit 900 serves as an indicator that indicates the amount of the gaming medium which is to be paid out via the hopper 54 according to the special determination made by the CPU 106 that the game state is to be switched to the jackpot game state (jackpot). With such an arrangement, based upon the quantity of the gaming effects gaming medium 650 retained by the retaining unit 900 provided within the water tank 500, the player can estimate the amount of the gaming medium which is to be paid out when the game state transits to the jackpot game state, thereby enhancing the player's sense of expectation.

Thus, such an arrangement provides improved game effects by using the water tank 500, while facilitating the player's ability to visually recognize the information displayed on the mechanical reels 30A through 30C.

Second Embodiment

In the following description of a second embodiment, the same components as those in the first embodiment are denoted by the same reference numerals, and a description thereof is omitted or simplified.

Figure 10:
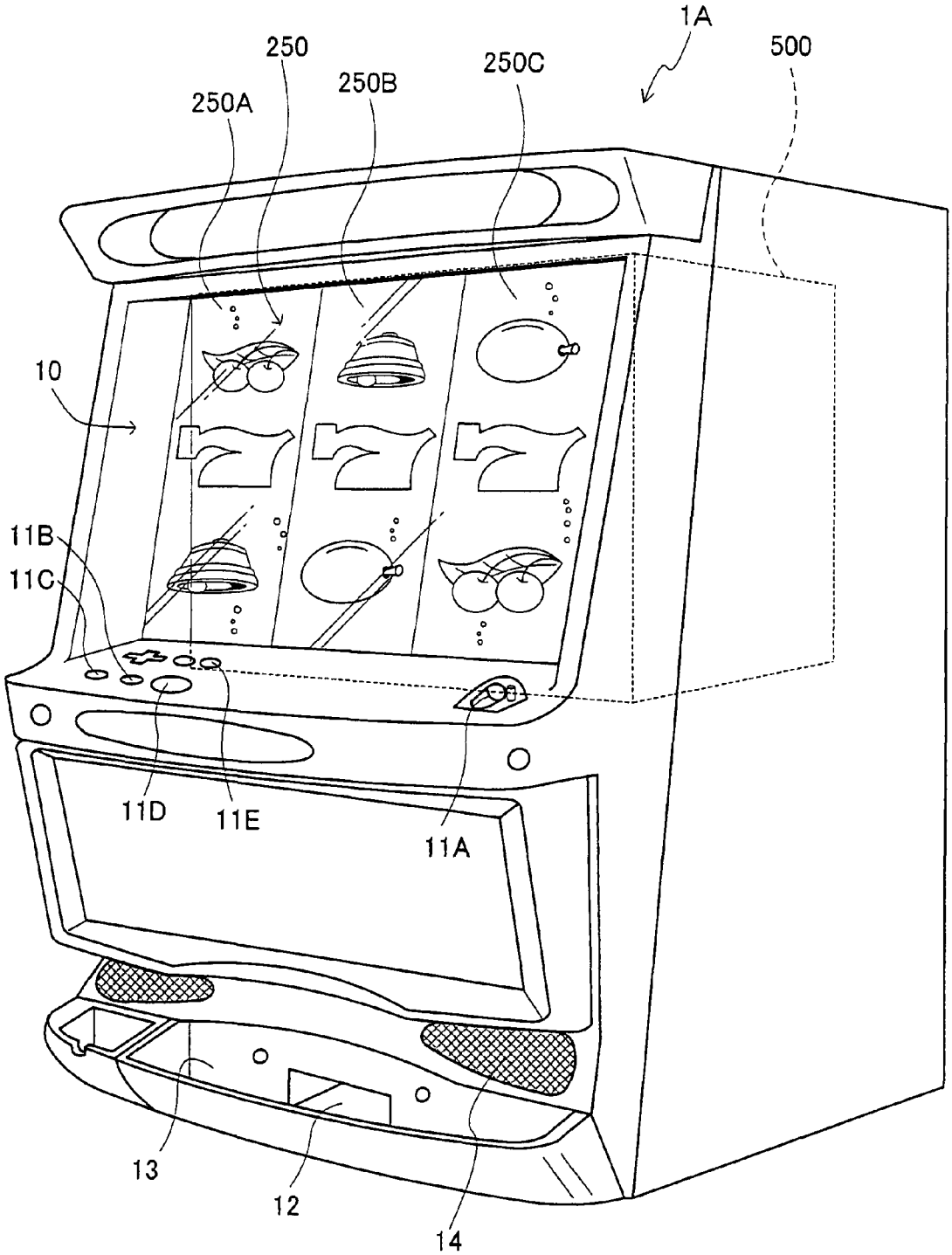
FIG. 10 is a perspective view showing the exterior of a slot machine according to a second embodiment of the present invention.

FIG. 10 is a perspective view showing the exterior of a slot machine 1A according to the second embodiment of the present invention.

Figure 11:
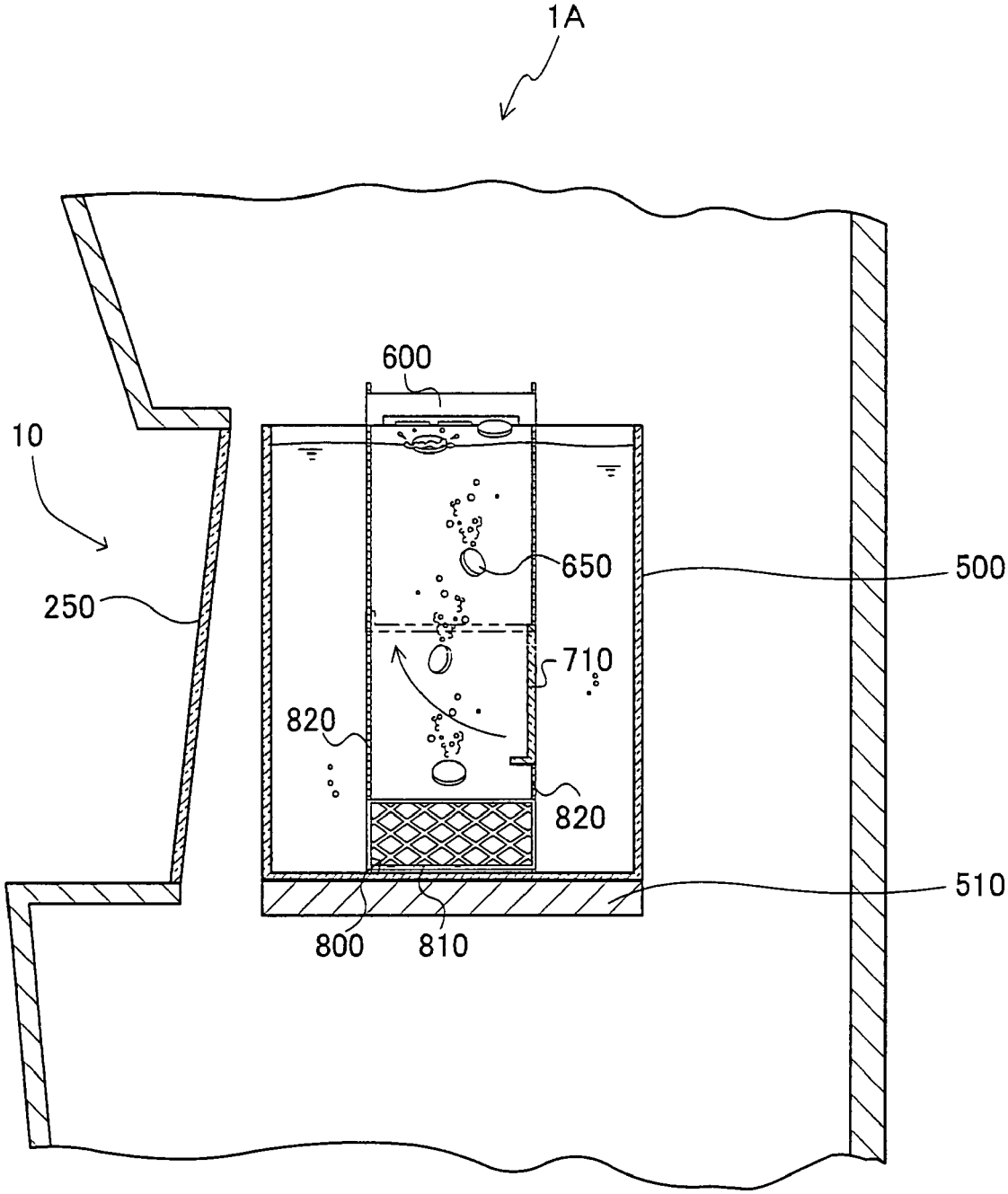
FIG. 11 is a cross-sectional view showing a liquid crystal display device and a water tank included in the slot machine according to the second embodiment of the present invention.

FIG. 11 is a cross-sectional view of a liquid crystal display device 250 and the water tank 500 included in the slot machine 1A according to the second embodiment of the present invention.

The slot machine 1A according to the second embodiment includes the liquid crystal display device 250 instead of the mechanical reels 30A through 30C included in the first embodiment, which is a point of difference from the first embodiment.

Furthermore, the slot machine 1A according to the second embodiment includes a display control device 200 instead of the motor driving circuit 120 included in the first embodiment, which is another point of difference from the first embodiment.

The liquid crystal display device 250 is provided forward of the water tank 500, and has a function of displaying multiple kinds of indicating information on three indicating information display regions 250A through 250C variably and statically. Here, each of the three indicating information display regions 250A through 250C has a structure in which a transparent substrate such as a glass substrate, upon which a thin film transistor layer has been formed, and another transparent substrate are mounted so as to face each other with a certain gap between them, and the gap between the substrates is filled with a liquid crystal.

In other words, the liquid crystal display device 250 is provided forward of the water tank, and serves as an example of a liquid crystal display device which provides a function of displaying the indicating information variably and statically.

Figure 12:
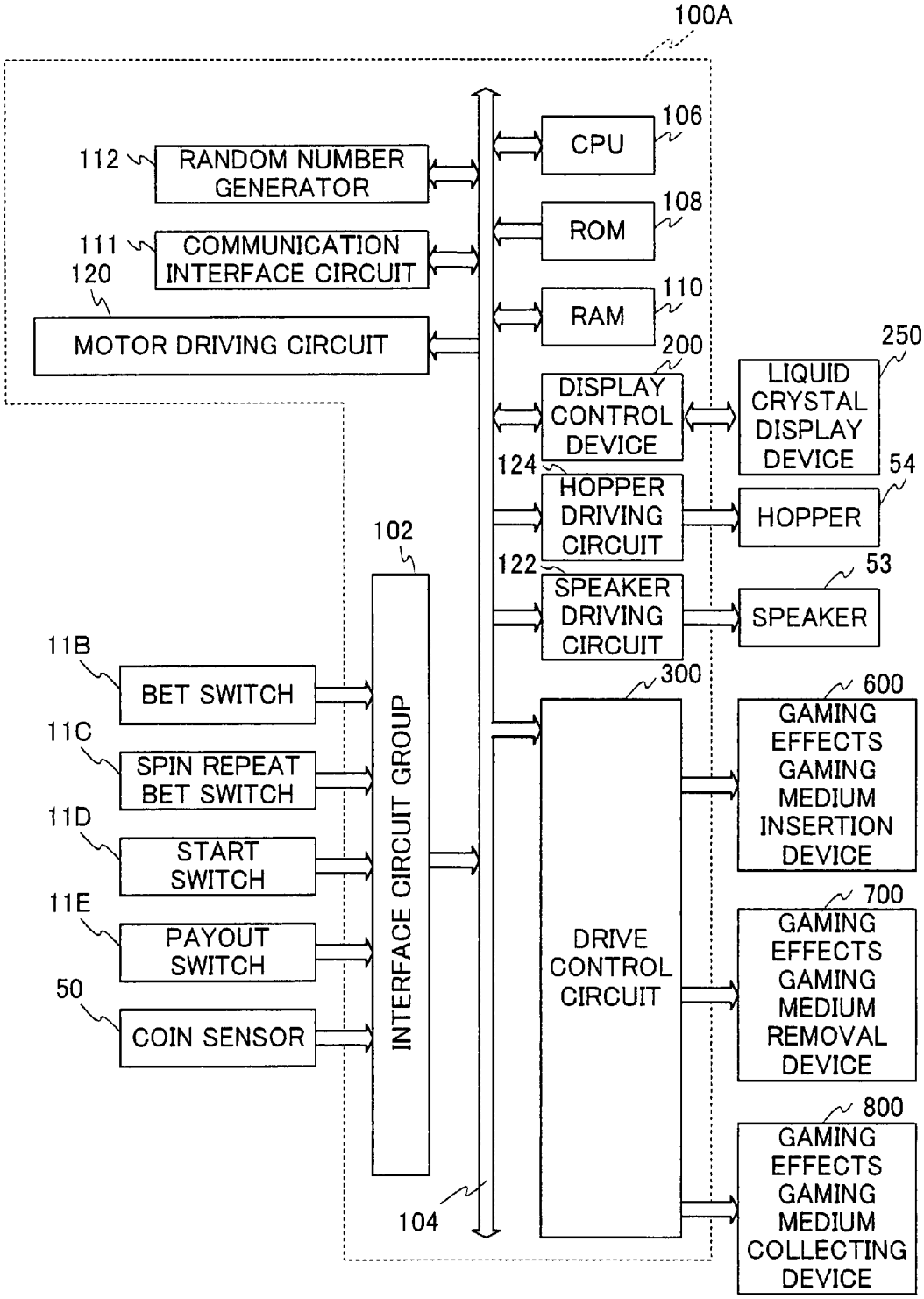
FIG. 12 is a block diagram showing an electrical configuration of a control device according to the second embodiment of the present invention.

FIG. 12 is a block diagram showing an electrical configuration of a control device 100A according to the embodiment of the present invention.

The display control device 200 is connected to the input/output bus 104. The CPU 106 generates an image display command corresponding to the state and results of the game, and outputs the image display command thus generated to the display control device 200 via the input/output bus 104. Upon reception of the image display command as an input signal from the CPU 106, the display control device 200 generates a drive signal for driving the liquid crystal display device 250 according to the image display command thus received. Then, the display control device 200 outputs the drive signal thus generated to the liquid crystal display device 250. With such an arrangement, the liquid crystal display device 250 provides a function of displaying multiple kinds of indicating information on the indicating information display regions 250A through 250C variably and statically.

In other words, the display control device 200 serves as an example of a display control means which is a display control circuit that controls the liquid crystal display device.

Next, a description is provided regarding the processing performed by the CPU 106, which executes a game provided by the slot machine 1, according to the second embodiment with reference to the flowchart shown in FIG. 5.

The processing denoted by step S1 and the processing denoted by step S2 are the same as those in the first embodiment.

In step S3, the CPU 106 performs indicating information variable display control processing. In this processing, the CPU 106 transmits a command to the display control device 200, which instructs the liquid crystal display device 250 to display the multiple kinds of indicating information variably. Upon reception of this command, the display control device 200 performs a control operation so as to display the multiple kinds of indicating information on the indicating information display regions 250A through 250C of the liquid crystal display device 250 variably. Upon completion of this processing, the CPU 106 switches the processing to step S4.

The processing denoted by step S4 and step S5 is the same as that in the first embodiment.

In step S6, the CPU 106 performs a control operation so as to display the indicating information in a predetermined special stationary state. In this processing, the CPU 106 transmits a command to the display control device 200, which instructs the liquid crystal display device 250 to display the multiple kinds of indicating information in the predetermined special stationary state (e.g., the indicating information "red 7", "red 7", and "red 7" are rearranged in the stationary state). After the multiple kinds of indicating information have been displayed on the indicating information display regions 250A through 250C of the liquid crystal display device 250 variably, upon reception of this command, the display control device 200 performs a control operation so as to display the indicating information in the predetermined special stationary state (e.g., the indicating information "red 7", "red 7", and "red 7" are rearranged in the stationary state). Upon completion of this processing, the CPU 106 switches the processing to step S7.

The processing denoted by step S7 is the same as that in the first embodiment.

In step S8, the CPU 106 performs a control operation so as to display the indicating information in a stationary state other than the aforementioned predetermined special state. In this processing, the CPU 106 transmits a command to the display control device 200, which instructs the liquid crystal display device 250 to display the indicating information in a stationary state other than the aforementioned predetermined special stationary state (e.g., a state other than the indicating information "red 7", "red 7", and "red 7" are rearranged in the stationary state) after the multiple kinds of indicating information have been displayed variably. Upon reception of this command, the display control device 200 performs a control operation so as to display the indicating information on the indicating information display regions 250A through 250C of the liquid crystal display device 250 in a stationary state other than the special stationary state after multiple kinds of indicating information have been displayed variably. Upon completion of this processing, the CPU 106 ends one game.

Next, a description is provided with reference to the flowchart shown in FIG. 6 regarding the jackpot game state control processing denoted by step S20 in FIG. 5, which is processing executed by the CPU 106, which controls the execution of the game provided by the slot machine 1, according to the second embodiment.

In step S21, the CPU 106 performs repeated indicating information variable display control processing. In this processing, the CPU 106 transmits a command to the display control device 200, which instructs the liquid crystal display device 250 to display multiple kinds of indicating information variably. Upon reception of this command, the display control device 200 performs a control operation which instructs the liquid display device 250 to display the multiple kinds of indicating information on the indicating information display regions 250A through 250C variably. Upon completion of this processing, the CPU 106 switches the processing to step S22.

The processing denoted by step S22 through step S25 is the same as that in the first embodiment.

In step S26, the CPU 106 performs a control operation, which displays the indicating information in a predetermined stationary display state. In this processing, after the multiple kinds of indicating information are displayed variably, the CPU 106 transmits a command to the display control device 200, which instructs the liquid crystal display device 250 to display the multiple kinds of indicating information in a predetermined special stationary display state (e.g., the indicating information "bell", "bell", and "bell" are rearranged in the stationary display state). Upon reception of this command, after the multiple kinds of indicating information are displayed variably, the display control device 200 performs a control operation which instructs the liquid crystal display device 250 to display the multiple kinds of indicating information on the indicating information display regions 250A through 250C in the predetermined stationary display state (e.g., the indicating information "bell", "bell", and "bell" are rearranged in the stationary display state). Upon completion of this processing, the CPU 106 switches the processing to step S27.

The processing denoted by step S27 is the same as that in the first embodiment.

In step S28, the CPU 106 performs a control operation which displays the indicating information in a stationary display state other than the predetermined special stationary display state. In this processing, after multiple kinds of indicating information are displayed variably, the CPU 106 transmits a command to the display control device 200, which instructs the liquid crystal display device 250 to display the indicating information in a stationary state other than the predetermined stationary display state (e.g., other than the indicating information "bell", "bell", and "bell" are rearranged in the stationary display state). Upon reception of this command, after the multiple kinds of indicating information are displayed variably, the display control device 200 performs a control operation which instructs the liquid crystal display device 250 to display indicating information in a stationary display state other than the predetermined stationary display state (e.g., other than the indicating information "bell", "bell", and "bell" are rearranged in the stationary display state). Upon completion of this processing, the CPU 106 ends one game.

The second embodiment provides the following advantage.

The liquid crystal display device 250, which is provided forward of the water tank 500, is employed as a display means. Furthermore, the display control device 200, which controls the liquid crystal display device 250, is employed as a display control means.

Such an arrangement allows the indicating information to be displayed variably and statically using various images. Furthermore, with such an arrangement, the liquid crystal display device 250 is formed of a translucent material, and is provided forward of the water tank 500. Such an arrangement allows the indicating information and the water tank to be displayed in a superimposed manner.

Thus, such an arrangement provides improved visual effects by using the water tank, while facilitating the player's ability to visually recognize the information displayed by the display means.

The embodiments according to the present invention have been described above with reference to specific examples for exemplary purposes only, and it should be clearly understood that the embodiments in no way restrict the present invention. That is to say, the gaming machine according to the present invention principally includes: an operating means for allowing the player to operate the gaming machine; a game control means having a function whereby, when the player performs an operation on the operating means, determination is made of whether or not the game state is to be switched to a special game state advantageous to the player; a display means for displaying multiple kinds of indicating information variably and statically that is formed of a translucent material; a display control means for controlling, according to the determination made by the game control means, the display operation of the display means for displaying the indicating information variably and statically; a water tank that retains liquid and is formed of a translucent material, which is provided behind the display screen for displaying the indicating information provided on the display means; a special game control means having a function whereby, when the player operates the operating means, a special determination is made of whether or not the game state is to be switched to a jackpot game state advantageous to the player; a payout means for paying out units of the gaming medium; a payout control means for performing a control operation which instructs the payout means to pay out a predetermined amount of the gaming medium according to the determination made by the game control means; a retention means for deducting a portion from the predetermined amount of the gaming medium to be paid out under the control of the payout control means, and retaining the portion thus deducted; an insertion means for inserting units of a gaming effects gaming medium into the water tank; and an insertion control means for controlling the insertion means. With such an arrangement, in a case where the special game control means has made a special determination that the game state is to be switched to the jackpot game state, the payout control means performs a control operation which instructs the payout means to pay out the units of the gaming medium retained by the retention means. The insertion control means performs a control operation which instructs the insertion means to insert units of the gaming effects gaming medium into the water tank according to the special determination made by the special game control means. With such an arrangement, the specific components such as the operating means, the game control means, the display means, the display control means, the water tank, the special game control means, the payout means, the payout control means, the retention means, the insertion means, the insertion control means, etc., may be modified and altered as necessary.

Moreover, it should be noted that the advantages described in association with the embodiments of the present invention are merely a listing of most preferred advantages of the present invention, and that the advantages of the present invention are by no means restricted to those described in connection with the embodiments of the present invention.

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims.

EXPLANATION OF THE REFERENCE SYMBOLS

1, 1A: slot machine
10: display screen
11: operation panel
12: coin payout opening
13: coin tray
14: sound output unit
30: reel group
30A to 30E: mechanical reel
100, 100A: control device
102: interface circuit group
104: input/output bus
106: CPU
108: ROM
110: RAM
111: communication interface circuit
112: random number generator
120: motor driving circuit
122: speaker driving circuit
124: hopper driving circuit
128: display unit driving circuit
200: display control device
250: liquid crystal display device
300: drive control circuit
500: water tank
600: gaming effects gaming medium insertion means
700: gaming effects gaming medium removal device
800: gaming effects gaming medium collection device
900: retaining unit

What is claimed is:

1. A gaming machine comprising:

an operating device for allowing a player to operate the gaming machine;

a game control device having a function whereby, when the player performs an operation on the operating device, determination is made of whether or not a game state is to be switched to a special game state advantageous to the player;

a display device for displaying multiple kinds of indicating information variably and statically that is formed of a translucent material;

a display control device for controlling, according to the determination made by the game control device, a display operation of the display device for displaying the indicating information variably and statically;

a water tank which is provided behind a display screen for displaying the indicating information provided by the display device, retains liquid, and is formed of a translucent material;

a special game control device having a function whereby, when the player operates the operating device, determination is made of whether or not the game state is to be switched to a jackpot game state advantageous to the player;

a payout device for paying out units of a gaming medium;

a payout control device for performing a control operation which instructs the payout device to pay out an amount of the gaming medium according to the determination made by the game control device;

a retention device for deducting a portion from the predetermined amount of the gaming medium to be paid out under the control of the payout control device, and retaining the portion thus deducted;

an insertion device for inserting units of a gaming effects gaming medium into the water tank; and an insertion control device for controlling the insertion device, wherein in a case where the special game control device has made a special determination that the game state is to be switched to a jackpot game state, the payout control device performs a control operation which instructs the payout device to pay out the units of the gaming medium retained by the retention device, and the insertion control device performs a control operation which instructs the insertion device to insert units of the gaming effects gaming medium into the water tank according to the special determination made by the special game control device.

2. A gaming machine according to claim 1, further comprising:

a removal device for removing the units of the gaming effects gaming medium, which have been inserted into the water tank by the insertion device, from the interior of the water tank; and a removal control device for controlling the removal device according to the special determination made by the special game control device.

3. A gaming machine according to claim 1, further comprising a gaming effects retention device for retaining in the water tank the units of the gaming effects gaming medium inserted into the water tank by the insertion device, wherein the insertion control device performs a control operation which instructs the insertion device to insert into the water tank a quantity of the gaming effects gaming medium according to the amount of the gaming medium retained by the retention device.

4. A gaming machine according to claim 2, further comprising a gaming effects retention device for retaining in the water tank the units of the gaming effects gaming medium inserted into the water tank by the insertion device, wherein the insertion control device performs a control operation which instructs the insertion device to insert into the water tank a quantity of the gaming effects gaming medium according to the amount of the gaming medium retained by the retention device.

* * * * *